US006725945B2

(12) United States Patent
Sugimoto et al.

(10) Patent No.: US 6,725,945 B2
(45) Date of Patent: Apr. 27, 2004

(54) IMPACT TOOL WITH IMPROVED OPERABILITY

(75) Inventors: Manabu Sugimoto, Nukata-gun (JP); Hidenori Nagasaka, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/295,334

(22) Filed: Nov. 14, 2002

(65) Prior Publication Data

US 2003/0089510 A1 May 15, 2003

(30) Foreign Application Priority Data

Nov. 15, 2001 (JP) ..... 2001-350543

(51) Int. Cl.[7] ..... B25D 17/00

(52) U.S. Cl. ..... 173/117; 173/203; 173/205; 173/104; 173/109

(58) Field of Search ..... 173/93, 93.5, 93.6, 173/104, 109, 117, 178, 203, 205, 210, 211

(56) References Cited

U.S. PATENT DOCUMENTS 3,908,139 A * 9/1975 Duncan, Jr. ..... 310/50
4,384,622 A * 5/1983 Koziniak ..... 173/205
5,320,177 A * 6/1994 Shibata et al. ..... 173/48
5,375,665 A * 12/1994 Fanchang et al. ..... 173/48
5,451,127 A * 9/1995 Chung ..... 408/20

FOREIGN PATENT DOCUMENTS

JP 7-148669 6/1995

* cited by examiner

*Primary Examiner*—Scott A. Smith
*Assistant Examiner*—Chukwurah Nathaniel
(74) *Attorney, Agent, or Firm*—Lahive & Cockfield, LLP; Anthony A. Laurentano

(57) ABSTRACT

An impact driver (1) includes a main housing (2) encasing a motor (5); an internal gear case (8) which is secured by screws to the main housing (2) and is provided with an externally threaded portion (12); and a hammer case (13) with an internally threaded portion (14) which is adapted for threadable engagement with the externally threaded portion (12) of the internal gear case (8) so as to couple the hammer case (13) to the internal gear case (8). The impact driver (1) additionally includes a rotation stop mechanism comprised of a rack (24) disposed within a forward extending portion (23) of the main housing (2) for meshing with dimples (27) formed in the outer surface of the hammer case (13). By fixing the rack (24) with a feed screw (26) disposed transversely in the forward extending portion (23), the hammer case (13) is prevented from rotation with respect to the internal gear case (8) after assembly of the impact driver (1). The impact driver (1) further includes an LED light unit (28) disposed in the extending portion (23) forward of the rotation stop mechanism so as to illuminate objects in front of the hammer case (13).

9 Claims, 5 Drawing Sheets

IMPACT TOOL WITH IMPROVED OPERABILITY

This application claims priority on Japanese Patent Application No. 2001-350,543 filed on Nov. 15, 2001.

BACKGROUND OF THE INVENTION

1. Field of the Invention

The present invention generally relates to impact power tools. More particularly, the present invention relates to an impact driver which includes a housing containing a motor and further includes a hammer case which is assembled to the front end of the main housing and contains an impact mechanism.

2. Description of the Related Art

An impact driver generally includes a main housing that contains a motor and a hammer case which is assembled to the front end of the main housing and contains an impact mechanism. As disclosed in Japan Published Unexamined Patent Application No. 7-148669, typically, the hammer case and the main housing of such an electric power tool are both provided with protuberances or bosses with screw holes such that the case can be assembled to the housing from the front of the tool by tightening screws into the screw holes.

While this arrangement achieves its intended objective, it is not free from certain problems and inconveniences. For example, the bosses, as they protrude from the outer peripheral surfaces of the main housing and the hammer case, may hinder or interfere with work in tight space, or damage the material, such as a board, being fastened, for example, with screws by the power tool during operation.

SUMMARY OF THE INVENTION

In view of the above-identified problems, an important object of the present invention is to provide an impact power tool with a main housing and a hammer case both having a simplified shape so as to improve the ease of use of the tool and work efficiency.

Another object of the present invention is to provide an electric power tool that is free from protrusions that may hinder the use of the tool.

The above objects and other related objects are realized by the invention, which provides an impact tool that includes a main housing containing a motor and having a front end. The tool further includes a hammer case containing an impact mechanism and having a rear end, with the hammer case being assembled to the front end of the main housing. The front end of the main housing includes a first threaded portion, whereas the rear end of the hammer case includes a second threaded portion adapted for threadable engagement with the first threaded portion of the main housing so as to couple the hammer case to the main housing. The impact tool additionally includes a rotation stop mechanism provided in the main housing at a position below the hammer case for engaging an outer surface of the hammer case so as to prevent rotation of the hammer case with respect to the main housing upon coupling of the hammer case to the main housing. Due to the foregoing arrangement (i.e., the threadable engagement between the hammer case and the main housing in combination with the provision of the rotation stop mechanism), the outer surfaces of the main housing and the hammer case are free of obstructive protrusions or protuberances, thus ensuring unimpeded tool operation and greatly reducing the possibility of damaging the material, such as a board, being fastened by the electric tool. The arrangement additionally ensures reliable connection between the main housing and the hammer case. Due to the simplified shapes of the main housing and the hammer case, the manufacture of these components is also advantageously simplified. As there are no protrusions on the hammer case and the internal gear case, there is no need to locate or position the hammer case with respect to the main housing during assembly, thus eliminating at least one step from the entire assembly procedure of the tool.

According to one aspect of the present invention, the hammer case is screwed on the main housing in a first direction so as to couple the hammer case to the main housing. Furthermore, the rotation stop mechanism includes: a plurality of recesses provided in the outer surface of the hammer case; a rack disposed in the main housing for being transversely slidable therein and capable of engaging the recesses; and a screw member which is inserted into the rack from a side surface of the main housing and threadably engages the rack, the screw member being capable of causing the rack to travel in the first direction when tightened into the rack. This arrangement realizes a simply constructed and reliable mechanism for stopping the rotation of the hammer case.

According to another aspect of the present invention, the impact tool further includes an on/off trigger below the hammer case for activating the motor. The rotation stop mechanism is disposed immediately above the on/off trigger between the trigger and the hammer case.

According to still another aspect of the present invention, the main housing includes a forward extending portion protruding therefrom above the on/off trigger and covering a lower portion of the hammer case.

According to yet another aspect of the present invention, the impact tool further includes an illuminant disposed in the main housing forward of the rotation stop mechanism so as to illuminate objects in front of the hammer case. In this way, the illuminant can be disposed in an advantageous position without compromising the simple outer shape of the impact tool.

According to one feature of the present invention, the forward extending portion includes an opening at a front end thereof into which the illuminant is inserted, and furthermore the illuminant is oriented at an upwardly inclined angle.

In one embodiment of the invention, the main housing includes an internal gear case having a ring portion which has an outer peripheral surface. The first threaded portion is provided as an external thread in the outer peripheral surface of the ring portion. Furthermore, the hammer case includes an opening at a rear end thereof The second threaded portion is provided as an internal thread in an inner peripheral surface of the opening of the hammer case.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment of the present invention will be described hereinafter with reference to the attached drawings.

Figure 1:
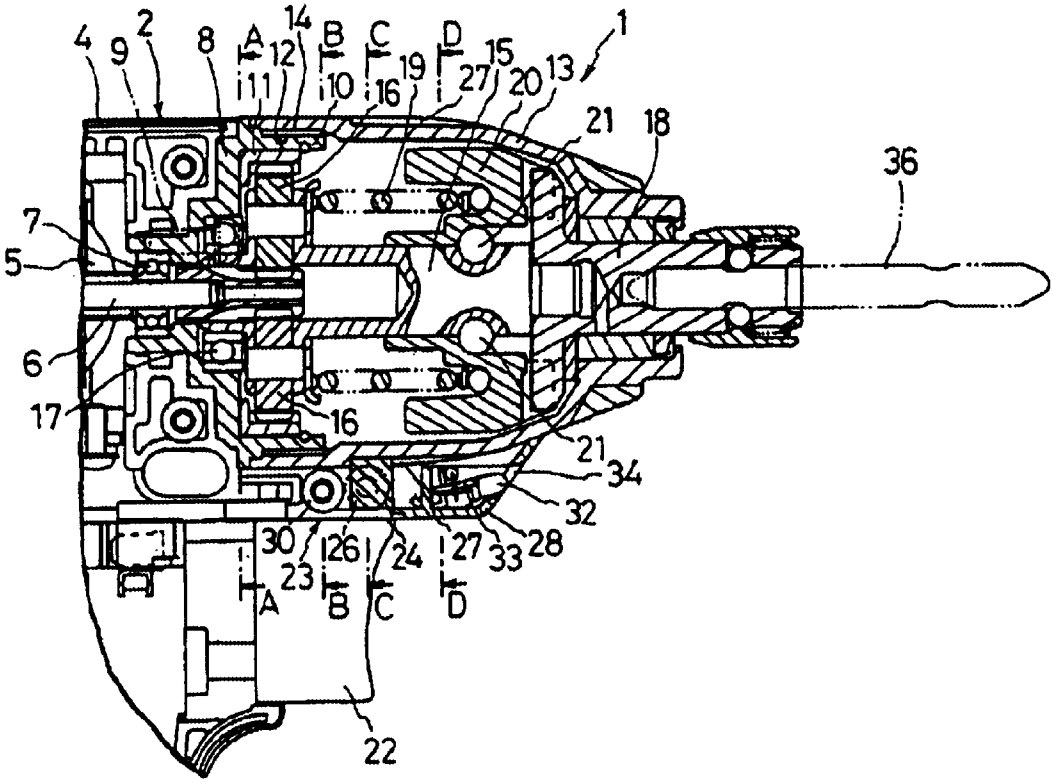
FIG. 1 is a longitudinal cross-sectional view of an essential part of an impact driver 1 in accordance with the present invention.
Figure 2:
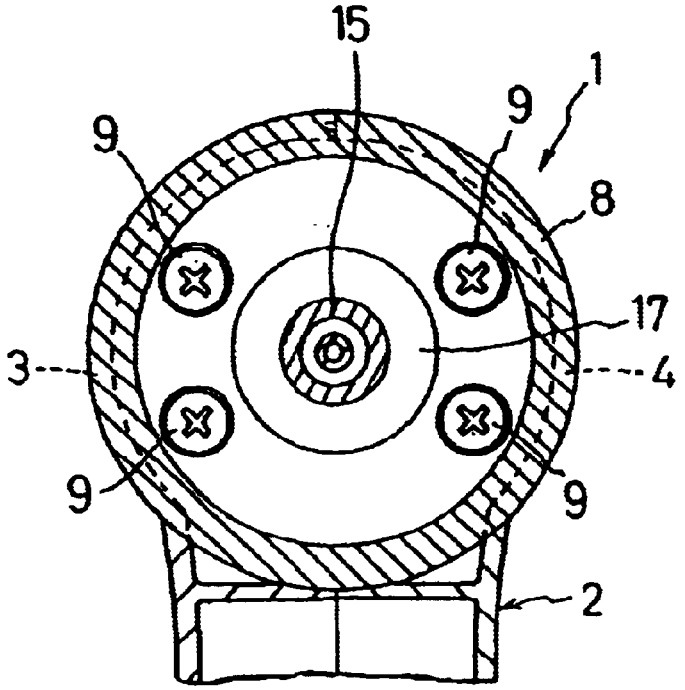
FIG. 2 is a transversal cross-section view of the impact driver 1 taken along the A—A line of FIG. 1.

FIG. 1 is a longitudinal cross-sectional view of an essential part of an impact driver 1 according to the present invention. The impact driver 1 includes a main housing 2 formed by fitting together a pair of right and left split-half clamshells 3 and 4 in which a motor 5 with an output shaft 6 is accommodated. An internal gear case 8 and a hammer case 13 are assembled forward (the right side in the drawing) of the motor 5. As also shown in FIG. 2, the internal gear case 8 is secured to the main housing 2 with four screws 9 from the front and supports the output shaft 6 of the motor 5 via a ball bearing 7. In addition, the internal gear case 8 includes at its front end a ring portion 10 which holds the internal gear 11 therein, whereas an externally threaded portion 12 (left-hand thread) is provided in the outer peripheral surface of the ring portion 10.

The hammer case 13 has an approximate bell shape on a longitudinal cross section with an opening at the rear end. Provided in the inner surface of the rear end of the hammer case 13 is an internally threaded portion 14 that threadably engages the externally threaded portion 12 of the internal gear case 8. Accordingly, the hammer case 13 can be screwed on the internal gear case 8 by this threadable engagement between the externally and internally threaded portions 12 and 14, thus coupling the two cases 8 and 13 together. In addition, a spindle 15 is disposed within the hammer case 13 and supports a pair of planet gears 16. The rear end of the spindle 15 is in turn supported coaxially with the motor's output shaft 6 by a ball bearing 17 which is supported within a recess in the internal gear case 8. Furthermore, the spindle 15 is loosely inserted into an anvil 18 which is coaxial with the spindle 15 and supported by the hammer case 13. The impact driver 1 additionally includes a hammer 20 about the forward portion of the spindle 15 within the hammer case 13. The hammer 20 is biased in the forward direction by a coil spring 19 into engagement with the rear surface of the anvil. Additionally, the hammer 20 is coupled to the front end portion of the spindle 15 via a pair of balls 21.

Figure 4:
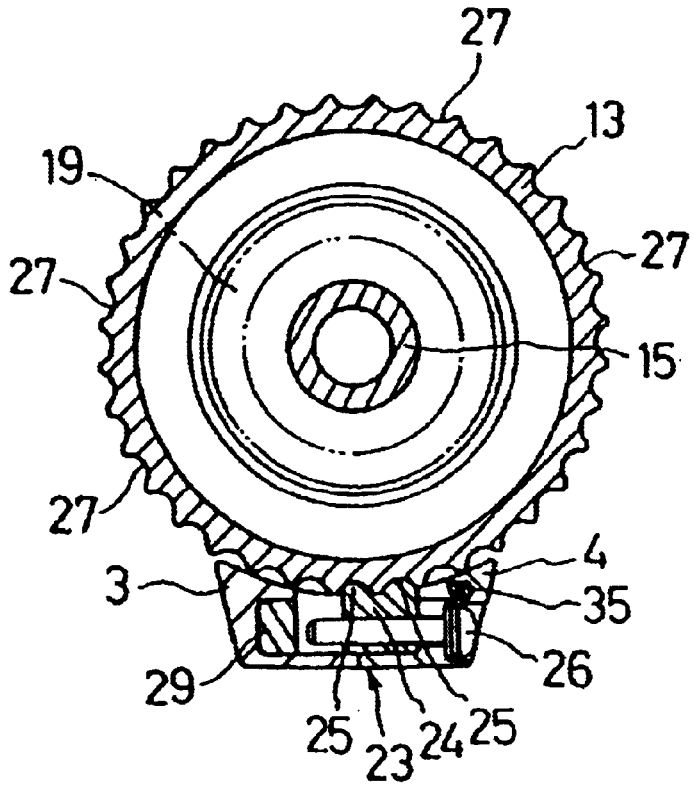
FIG. 4 is a transversal cross-section view of the impact driver 1 taken along the C—C line of FIG. 1.

Still referring to FIG. 1, the main housing 2 includes a forward extending portion 23 protruding therefrom above an on/off trigger 22 and covering the lower portion of the hammer case 13. The forward extending portion 23 has an opening at its front end. As also shown in FIG. 4, a rack 24 is disposed within the forward extending portion 23 in a manner that permits its lateral (right-to-left as viewed in FIG. 4) movement. Additionally, a screw 26 is loosely inserted into the forward extending portion 23 from the split-half clamshell 4, penetrating and threadably engaging the rack 24. The rack 24 includes a pair of teeth 25 on the upper surface thereof. The teeth 25 are adapted to engage a plurality of recesses or dimples 27 which are circumferentially arranged at regular intervals in the outer peripheral surface of the hammer case 13. The rack 24, the screw 26, and the dimples 27 together constitute a mechanism for preventing the rotation of the hammer case 13 with respect to the main housing 2.

Figure 3:
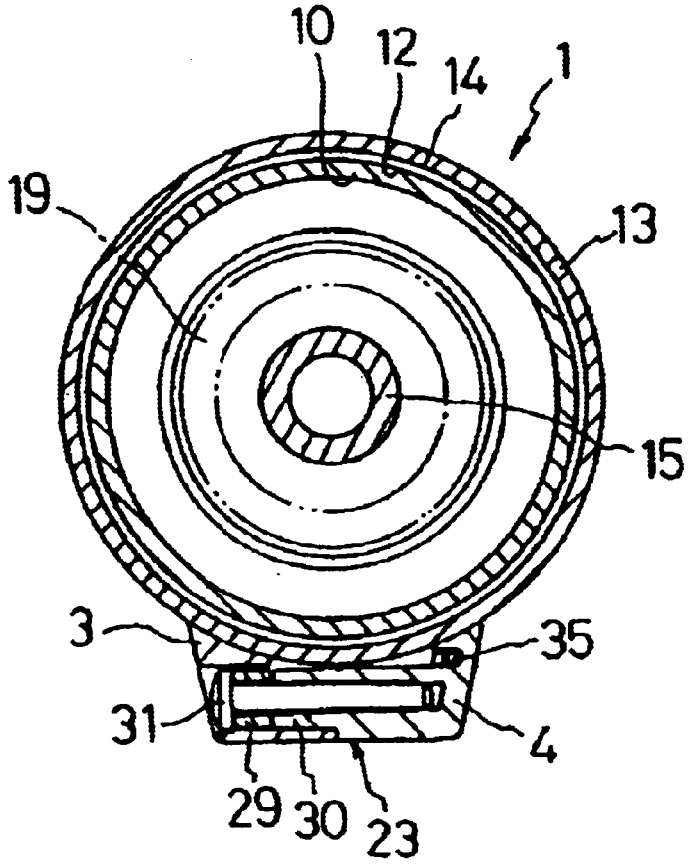
FIG. 3 is a transversal cross-section view of the impact driver 1 taken along the B—B line of FIG. 1.
Figure 5:
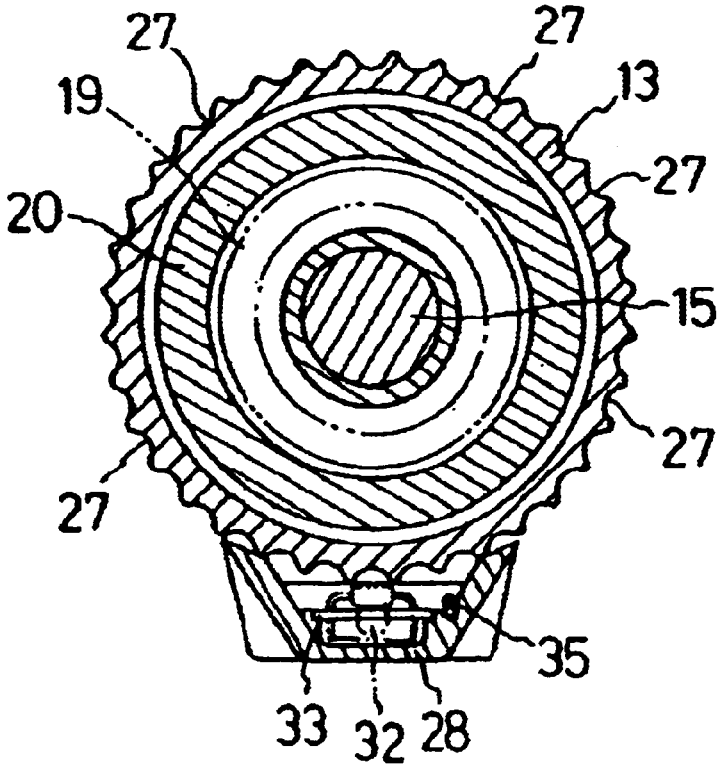
FIG. 5 is a transversal cross-section view of the impact driver 1 taken along the D—D line of FIG. 1.

Referring again to FIG. 1, the electric tool 1 further includes a light unit 28 at the front of the forward extending portion 23. As best seen in FIG. 1, the light unit 28 has a generally half-bowl shape. The rear end of the light unit 28 is connected to the front opening of the forward extending portion 23 by means of a socket and spigot joint. The light unit 28 additionally includes a connector plate 29 which is connected in the forward extending portion 23 to a boss 30 provided on the clamshell 4 by a screw 31, snugly fitting the unit 28 to the under surface of the hammer case 13 (see FIG. 3). As additionally shown in FIG. 5, a circuit board 33 is fixed in the light unit 28 so as to orient a light-emitting diode (LED) 32 on the circuit board at an upwardly inclined angle. The light from the LED 32 goes through a through-hole 34 provided at the front of the light unit 28 in order to illuminate workpieces. The light unit 28 further includes a lead wire 35 which is routed within the unit 28 and the forward extending portion 23 and electrically connected to the drive circuit (not shown) of the motor 5.

To assemble the impact driver 1, the internal gear case 8 is secured to the main housing 2 by the screws 9. The hammer case 13 is screwed on the ring portion 10 of the internal gear case 8 to a predetermined torque value, with the anvil 18 supported by the hammer case 13 and with the spindle 15 and other components set in place in the internal gear case 8. The rack 24 is then inserted into the forward extending portion 23 from the front opening thereof so as to engage the rack's teeth 25 with the dimples 27 of the hammer case 13. When the feed screw 26 is inserted into the rack 25 from the left side (as viewed in FIG. 4) of the forward extending portion 23 and tightened, the rack 25 is caused to travel to the right. In this way, the hammer case 13, which is fastened to the internal gear case 8 via the left-hand thread engagement, is firmly locked with no play with respect to the rack 24. As illustrated, the tool 1 is constructed such that at least three protrusions between dimples 27 are exposed within the interior of the forward extending portion 23 at any rotational position of the hammer case 13, ensuring engagement of the teeth of the rack 24 with the dimples 27 and easy locking of the hammer case 13.

Upon assembly of the circuit board 33 (which is coupled to the lead wire 35) to the light unit 28, the unit 28 is screwed to the forward extending portion 23 as described above to complete the assembly of the impact driver 1.

In the operation of an impact driver 1 thus constructed, when the on/off trigger 22 is operated to drive the motor 5, the rotation of the motor's output shaft 6 is transmitted to the spindle 15 via the planet gears 16, thus rotating the spindle 15. The spindle 15, now in rotation, in turn rotates the hammer 20 via the balls 21. This also rotates the anvil 18, as the anvil is engaged by the hammer 20, thus enabling various operations such as screw tightening with the tool bit 36 attached to the top of the anvil 18. Additionally, the LED 32 is lit simultaneously with the activation of the motor 5, thus illuminating the screw and other objects located in front of the tool bit 36.

When the load on the anvil 18 builds up as the screw tightening operation progresses, the hammer 20 is retracted against the biasing force of the coil spring 19, temporarily disengaging itself from the anvil 18. The hammer 20 is then moved forward into reengagement with the anvil 18 by the biasing force of the coil spring 19 while rotating together with the spindle 15. By the repeated cycles of the hammer's disengagement and engagement with the anvil 18, intermittent impacts are transmitted to the anvil 18, permitting additional tightening of the screw or other appropriate workpiece. Vibration is generated in the impact driver 1 due to the above-described successive impacts. In particular, the hammer case 13 is most severely exposed to such vibration as it is disposed at the front of the tool 1. However, this vibration does not cause the hammer case 13 to loosen from the internal gear case 8 as the hammer case 13 is secured from rotation by the rack 24.

As can be seen from the foregoing description, in the impact driver 1 of the embodiment, the hammer case 13 is secured to the internal gear case 8 by the threadable engagement therebetween and is additionally prevented from inadvertent rotation and loosening from the gear case 8 by the rotation stop mechanism. This arrangement eliminates protrusions/protuberances, such as bosses, that have been required in conventional power tools. The elimination of the protrusions offers a number of advantages. For example, work is no longer hindered by such protrusions; the material, such as a board, being fastened by the electric tool is less likely to be damaged; the hammer case 13 can be securely coupled to the internal gear case 8; the shapes of the main housing 2 and the hammer case 13 are simplified, such that the manufacture of these components becomes simplified; and as there are no protrusions on the hammer case 13 and the internal gear case 8, there is no need to locate or position the hammer case 13 with respect to the main housing 2 during the assembly, thus eliminating at least one step from the entire assembly procedure.

Furthermore, the mechanism for stopping the rotation of the hammer case 13 is simply constructed from the dimples 27 formed in the hammer case 13, the rack 24 for meshing with the dimples 27, and the screw 26 for feeding the rack 24 in the direction in which the hammer case 13 is screwed on the internal gear case 8, ensuring reliable and effective prevention of the rotation of the hammer case 13 relative to the gear case 8.

The light unit 28 in the impact driver 1 of the foregoing embodiment additionally provides sufficient illumination for work in dark or dim working environments. In particular, the light unit 28 is advantageously tucked in the front portion of the forward extending portion 23 (where the rotation-stopper mechanism is accommodated), thus disposing the light unit in a convenient and suitable position in the impact driver 1 without compromising the simplified outer shape of the tool.

In the foregoing embodiment, the hammer case 13 is screwed on the internal gear case 8 of the main housing 2. It should be noted that a threaded portion may be formed in the main housing 2 rather than in the gear case 8, such that the hammer case is directly coupled to the housing 2 by means of a screw. Furthermore, the invention is equally practicable if a female or internal thread is provided on the main housing 8, with a male or external thread provided on the hammer case 13.

In the rotation stop mechanism, the number or shape of the dimples or recesses and/or the teeth of the rack may be changed or modified without departing from the scope of the present invention insofar as the rack can engage the recesses in the outer surface of the hammer case so as to prevent the rotation of the hammer case. Additionally, one of the light unit 28 and the forward extending portion 23 may include a plug with positive and negative male terminals, while the other is provided with a plug socket in order to facilitate the establishment of electrical contact between the light unit 28 and the drive circuit of the motor 5. Of course, the light unit may be omitted if illumination is not required.

It should be noted that the present invention is equally applicable to various types of impact tools other than impact drivers, such as angled impact drivers.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by Letters Patent is:

What is claimed is:

1. An impact tool, comprising:

a main housing containing a motor and having a front end;

a hammer case containing an impact mechanism and having a rear end, the hammer case being assembled to the front end of the main housing;

the front end of the main housing including a first threaded portion and the rear end of the hammer case including a second threaded portion adapted for threadable engagement with the first threaded portion of the main housing so as to couple the hammer case to the main housing; and a rotation stop mechanism provided in the main housing at a position below the hammer case for engaging an outer surface of the hammer case so as to prevent rotation of the hammer case with respect to the main housing upon coupling of the hammer case to the main housing.

2. An impact tool in accordance with claim 1, wherein the hammer case is screwed on the main housing in a first direction so as to couple the hammer case to the main housing, and further wherein the rotation stop mechanism includes:

a plurality of recesses provided in the outer surface of the hammer case;

a rack disposed in the main housing for being transversely slidable therein and capable of engaging the recesses; and a screw member which is inserted into the rack from a side surface of the main housing and threadably engages the rack, the screw member being capable of causing the rack to travel in the first direction when tightened into the rack.

3. An impact tool in accordance with claim 2 further comprising an on/off trigger below the hammer case for activating the motor, wherein the rotation stop mechanism is disposed immediately above the on/off trigger between the trigger and the hammer case.

4. An impact tool in accordance with claim 1 further comprising an on/off trigger below the hammer case for activating the motor, wherein the rotation stop mechanism is disposed immediately above the on/off trigger between the trigger and the hammer case.

5. An impact tool in accordance with claim 4, wherein the main housing includes a forward extending portion protruding therefrom above the on/off trigger and covering a lower portion of the hammer case.

6. An impact tool in accordance with claim 5 further comprising an illuminant disposed in the main housing forward of the rotation stop mechanism, the illuminant being capable of illuminating objects in front of the hammer case.

7. An impact tool in accordance with claim 6, wherein the forward extending portion includes an opening at a front end thereof into which the illuminant is inserted, and further wherein the illuminant is oriented at an upwardly inclined angle.

8. An impact tool in accordance with claim 1 further comprising an illuminant disposed in the main housing forward of the rotation stop mechanism, the illuminant being capable of illuminating objects in front of the hammer case.

9. An impact tool in accordance with claim 1, wherein the main housing includes an internal gear case having a ring portion, the ring portion having an outer peripheral surface in which the first threaded portion is provided as an external thread, and further wherein the hammer case includes an opening at a rear end thereof, the second threaded portion being provided as an internal thread in an inner peripheral surface of the opening.

* * * * *